United States Patent [19]

Oswald et al.

[11] 4,106,711

[45] Aug. 15, 1978

[54] CHUCK FOR A TUBE ACTING AS A PACKAGE SUPPORT

[75] Inventors: Heinz Oswald, Winterthur; Olivier Wüst, Seuzach, both of Switzerland

[73] Assignee: Rieter Machine Works Ltd., Winterthur, Switzerland

[21] Appl. No.: 850,226

[22] Filed: Nov. 10, 1977

[30] Foreign Application Priority Data

Dec. 31, 1976 [CH] Switzerland ..... 16503/76

[51] Int. Cl.[2] ..... B65H 75/32

[52] U.S. Cl. ..... 242/19; 242/18 A; 242/18 PW; 242/25 A

[58] Field of Search ..... 242/19, 18 PW, 18 A, 242/25 A, 125.1, 125

[56] References Cited

U.S. PATENT DOCUMENTS

| | | | |
|---|---|---|---|
| 3,149,795 | 9/1964 | Rhein, Jr. | 242/18 A |
| 3,801,038 | 4/1974 | Wust | 242/19 |
| 3,809,326 | 5/1974 | Wust | 242/19 |

FOREIGN PATENT DOCUMENTS

| | | | |
|---|---|---|---|
| 974,536 | 4/1961 | Fed. Rep. of Germany | 242/18 A |
| 1,097,204 | 12/1967 | United Kingdom | 242/18 A |

*Primary Examiner*—Stanley N. Gilreath
*Attorney, Agent, or Firm*—Werner W. Kleeman

[57] ABSTRACT

A chuck device for a tube used for supporting thread packages of textile yarns or threads comprisng a thread severing ring provided with protruding substantially tooth-shaped cutting elements and an adjacent thread guide ring which, for the purpose of guiding the thread in a direction towards the thread severing ring, is provided with a thread guide surface extending beneath the cutting elements and an adjacent extension or projection. The extension has recess means and radially movable clamping means are arranged in the recess means. At the operational rotational speed of the chuck the radially movable clamping means in conjunction with the cutting elements form clamping points or locations for the thread caught therebetween.

8 Claims, 10 Drawing Figures

Fig. 1
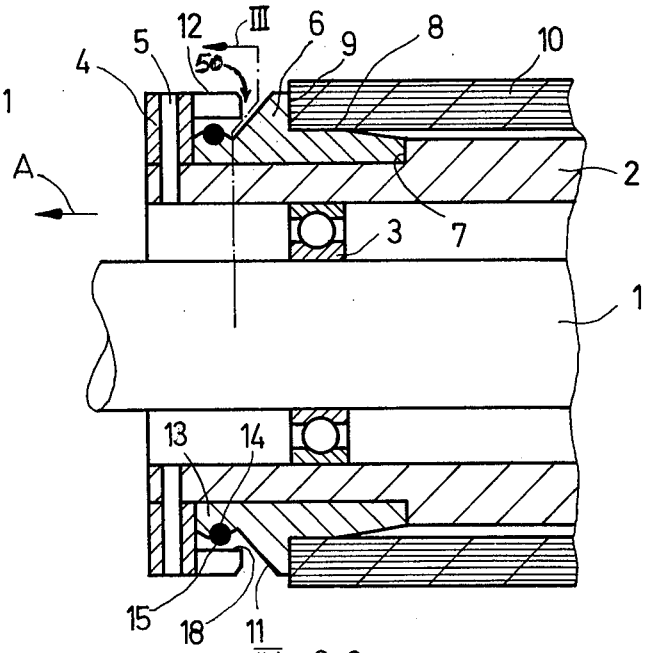
Fig. 2
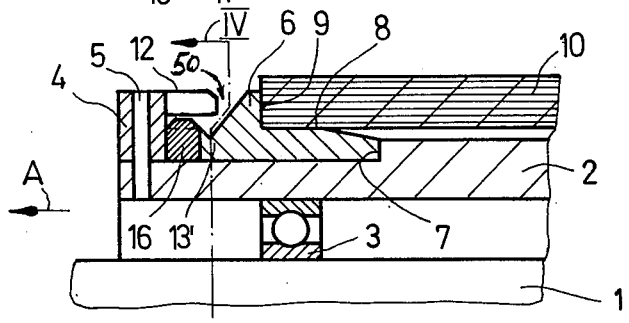
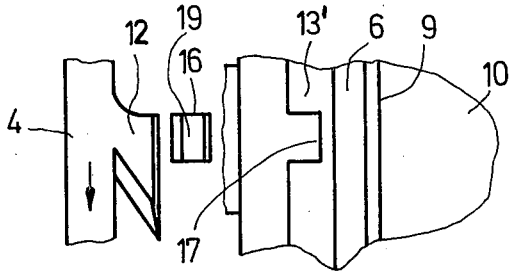
Fig. 2A

CHUCK FOR A TUBE ACTING AS A PACKAGE SUPPORT

BACKGROUND OF THE INVENTION

The present invention relates to a new and improved construction of a chuck device or mandrel for a bobbin tube or sleeve of the type used for supporting thread packages of textile yarns or threads comprising a thread severing ring and a thread guide ring.

In the commonly assigned U.S. Pat. 3,801,038, granted Apr. 2, 1974, and entitled "Chuck For A Tube Or Sleeve And Serving As A Bobbin Support", there is disclosed a chuck device of a thread winding machine for endless filaments or threads with an automatic bobbin or package tube change device in which two package tubes alternatively take-up the thread delivered at a high speed and after reaching a desired package or bobbin size, with simultaneous transfer of the thread to the empty package tube or sleeve, are rocked out of a work position into a waiting position. During the thread transfer the chuck is axially displaced, and the thread which is not being traversed, is caught by the thread guide ring and severed by the thread severing ring and thereafter is wound onto the empty package or bobbin tube with a number of reserve windings. The thread caught by the thread guide ring is clamped with the aid of clamping means between the thread guide ring and the thread severing ring and is seized and cut by the teeth of the thread severing ring. In order to ensure the free removal of the starting end of the thread clamped between the thread guide ring and the thread severing ring, upon completion of the winding process and while the completed package is doffed, the thread guide ring is arranged to be axially movable.

This state-of-the art chuck device is associated with the following disadvantages. The thread or the like is not always sufficiently clamped between the thread guide ring and the thread severing ring, so that sometimes the thread is not cleanly severed. Since either the thread guide ring or the thread serving ring must be arranged to be axially movable the equipment design is complicated.

SUMMARY OF THE INVENTION

Hence, with the foregoing in mind it is a primary object of the present invention to provide a new and improved construction of a chuck device for a bobbin tube acting as a package support which is not associated with the aforementioned drawbacks.

Another and more specific object of the present invention aims at obviating the previously discussed disadvantages and to provide a chuck device for a bobbin or package tube wherein the thread guide ring and the thread severing ring are rigidly arranged at the chuck in such a manner that there can be accomplished free removal of the starting end of the thread while the completed package is doffed, and further, ensuring that the thread is always securely clamped during the severing operation so that the thread is cleanly severed.

Yet a further significant object of the present invention aims at the provision of a new and improved construction of a chuck device for a package tube which is relatively simple in construction and design, extremely reliable in operation, not readily subject to breakdown or malfunction, and incorporating means for securely clamping the thread during such time that it is cut, to thereby ensure that the thread is always neatly severed.

Now in order to implement these and still further objects of the invention, which will become more readily apparent as the description proceeds, the chuck device for a tube of the type used for supporting thread packages of textile threads or yarns is manifested by the features that there is provided a thread severing ring having protruding tooth-shaped cutting elements and an adjacently arranged thread guide ring which, for the purpose of guiding the thread in a direction towards the thread severing ring, is provided with a guide surface extending beneath the cutting elements and with an adjacent extension or projection. The extension has thread clamping-receiving means in the form of one or more recesses in which there are arranged radially movable clamping means. At the operating rotational speed of the chuck the radially movable clamping means together with the cutting elements form clamping points or locations for the thread caught between the radially movable clamping means and the clamping elements.

According to an advantageous constructional embodiment there can be provided as the radially movable clamping means a resilient element for instance advantageously in the form of a rubber or elastomeric ring placed in the thread clamping-receiving means in the form of a groove provided at the extension, or the clamping means can be in the form of a number of clamping elements each of which are placed in a slot groove or slot means below an associated cutting element. Further, it can be advantageous if each of the cutting elements are provided with a side surface extending at an actute angle with respect to an end surface of the cutting element, and the edge of such side surface facing the clamping element, as viewed from the end surface, is structured as a thread guiding edge which merges with a thread cutting edge.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a fragmentary longitudinal sectional view of a chuck device with a package tube and constructed according to a first embodiment of the invention;

FIG. 2 is a fragmentary longitudinal sectional view of a chuck device with a package tube according to a second embodiment of the invention;

FIG. 2A is an exploded top view showing a detail of the chuck device of the embodiment of FIG. 2;

DETAILED DESCRIPTION OF THE PREFERRED EMBODIMENTS

Figure 1A:
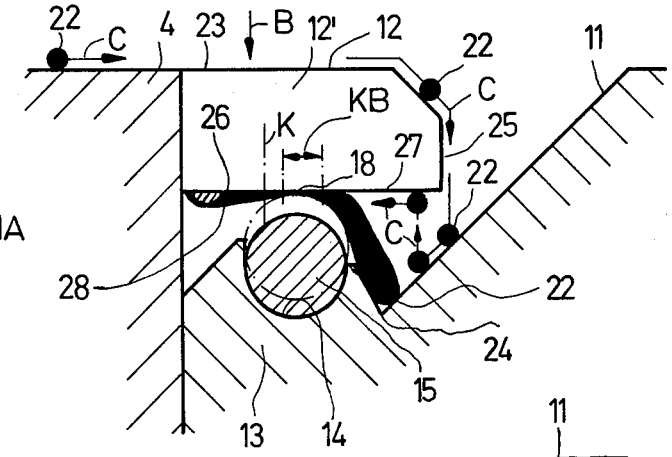
FIG. 1A is an enlarged cross-sectional detail showing of part of the chuck device illustrated in FIG. 1.

Describing now the drawings, in FIG. 1 there is shown a chuck device comprising a chuck or chuck means having a chuck shaft 1 equipped with anti-friction bearing means 3 supporting a chuck sleeve 2. At the machine end of the chuck sleeve 2, and which machine end has been generally indicated by the arrow A, a thread severing ring 4 is fixed to the chuck sleeve 2 by means of one or a number of bolts 5 or other suitable fastening expendients. A thread guide ring 6 is fixedly clamped or otherwise fixedly arranged between the thread severing ring 4 and a stop or impact shoulder 7 provided on the chuck sleeve 2. The thread severing ring 4 and the thread guide ring 6 are mounted on the chuck means so as to define therebetween a thread catch zone, generally indicated by reference character 50. The thread guide ring 6 will be seen to comprise a substantially cylindrical surface 8 for supporting the package or bobbing tube 10, a stop or impact shoulder 9 for the package tube 10, and a substantially conical thread guide surface 11 which faces towards the thread severing ring 4.

Figure 1B:
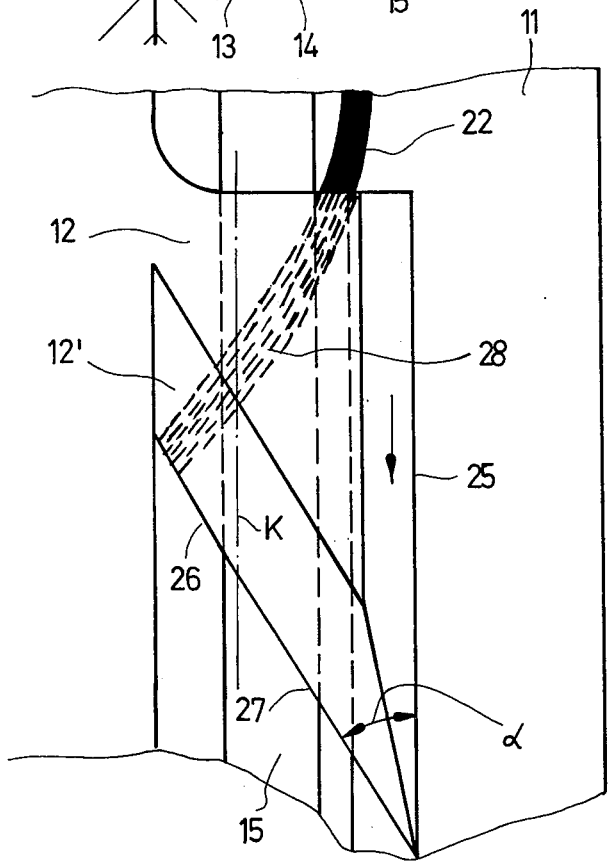
FIG. 1B is an enlarged top plan view of the detail showing of FIG. 1A, looking in the direction of the arrow B thereof.

Now as best seen by referring to FIGS. 1, 1A and 1B, the thread severing ring 4 embodies a substantially ring-shaped arrangement of tooth-shaped cutting elements 12 located at the side or face of such thread severing ring which faces the conical thread guide surface 11. These cutting elements 12 will be seen to extend over a part of the conical thread guide surface 11 and each such cutting element 12 has a tooth side surface 12′ provided with an edge or edge means 26, 27 for guiding and severing the thread 22 or the like. The tooth side surface 12′ extends at an acture angle $\alpha$ with respect to the tooth end surface 25 and the lower edge means 26, 27 embodies a thread guide edge 27 merging with a thread cutting edge 26. Furthermore, the thread guide ring 6, at a location adjacent to the substantially conical thread guide surface 11, consists of a substantially ring-shaped extension or projection 13 dispositioned beneath the cutting elements 12, and a radial groove 14 provided in the extension 13 defines recess means for receiving threads clamping means here in the form of a rubber or elastomeric ring 15 seated in such groove 14. The clamping element in the form of the rubber ring 15 is placed into the groove 14 with a pre-tension selected such that the rubber ring 15 contactingly rests in the groove 14 when the chuck is at standstill, but the rubber ring 15 is somewhat moved out of the groove 14 under the action of the centrifugal force when the chuck is rotating at its high operating speed and is pressed with great force against the underside 18 of the cutting elements 12. The dimensions of the rubber ring 15 and its pre-tension are experimentally determined according to the chuck and its operating rotational speed.

The position of the elastomeric or rubber ring 15 during the above-discussed operating state i.e., the clamping position, has been indicated in FIG. 1A by dash-dot or phantom lines.

Now the chuck device illustrated in FIGS. 2, 2A, 4 and 5 essentially corresponds to the chuck device described with reference to FIGS. 1, 1A, 1B and 3, except that instead of the rubber or elastomeric ring 15 shown in FIG. 1, here there is provided a clamping element 16 beneath each cutting element 12. Each such clamping element 16 is movably guided in a related slot groove 17 formed in the extension or projection, here indicated by reference character 13′, and as best seen by referring to FIG. 2A. Each clamping element 16 is provided with a circular-shaped or arc-shaped clamping surface 19 accommodated to the underside 18 of the cutting elements 12. In all other respects the chuck device of this embodiment is like that shown in FIG. 1, and therefore there have been generally used the same reference characters to denote the same components.

Figure 6:
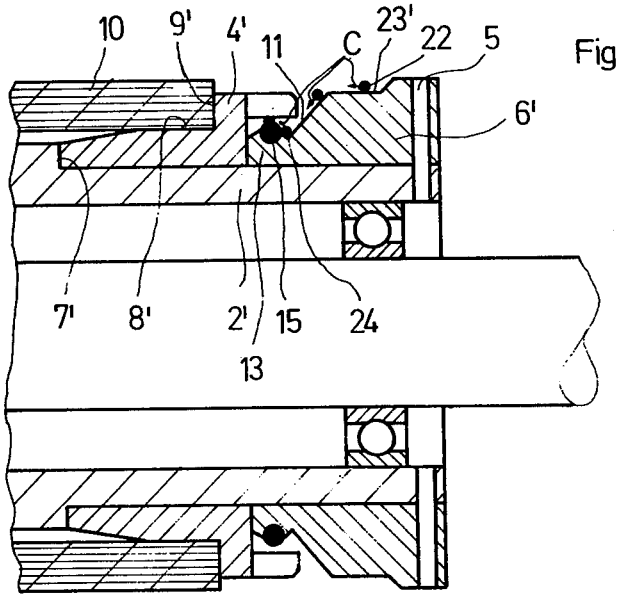
FIG. 6 is a fragmentary longitudinal sectional view of a variant construction of the chuck device of FIG. 1.

In FIG. 6 there is illustrated a further embodiment of chuck device constituting a modification of that described above with reference to FIG. 1. The difference here resides in that the positions of the thread guide ring and the thread severing ring are exchanged in such a manner that the thread severing ring 4′ for receiving the package tube 10 is provided with a tube take-up or support surface 8′ and with a stop 9′, and the thread guide ring 6′ is fixed to the chuck sleeve 2′ by means of one or more of the bolts 5 or equivalent fastening means. The thread severing ring 4′ is fixedly arranged between the thread guide ring 6′ and the stop 7′. Also in this arrangement there can be used clamping elements 16 of the type considered with regard to the embodiment of FIG. 2 instead of the clamping means in the form of the rubber ring 15.

Figure 7:
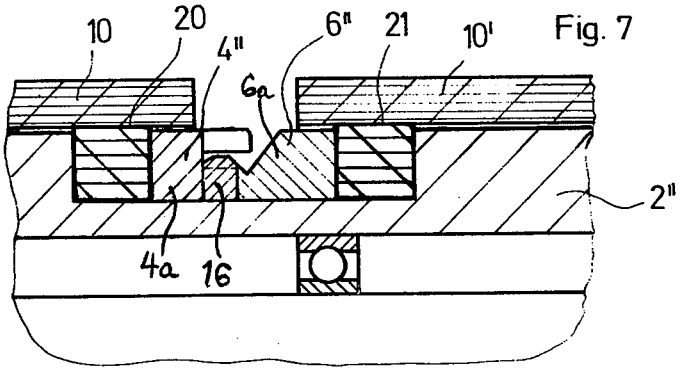
FIG. 7 is a fragmentary longitudinal sectional view of a variant construction of chuck device of the embodiment illustrated in FIG. 2.

Finally, FIG. 7 illustrates a further embodiment of chuck device constituting a modification from that considered previously with respect to FIG. 2. In this modified version the chuck device is designed to take-up or support two tubes, i.e. a tube 10 and a tube 10′. Both tubes 10 and 10′ are releasably held in axial direction by any suitable tube fixing and longitudinally positioning means 20 and 21, respectively. The thread severing ring 4″ and the thread guide ring 6″, respectively, are subdivided into individual segments, generally indicated by reference characters 4*a* and 6*a*, respectively, and each segment is fixed to the chuck sleeve 2″ by means of any suitable fastening device, such as not particularly illustrated threaded bolts. Also with this modified version there equally exists the possibility of using either the shown clamping elements 16 or the rubber ring 15.

Now if a thread, yarn or other filamentary material, as indicated generally by reference character 22 in FIGS. 1A and 6 — usually simply referred to herein as a thread — is to be transferred during the package tube change operation, for instance as described in the commonly assigned U.S. Pat. No. 3,856,222, granted Dec. 14, 1974 or U.S. Pat. No. 3,951,922, granted Nov. 25, 1975, and the disclosures of which are incorporated herein by reference, from a full package to an empty package tube, then the thread 22 is brought from its position on the thread guide ring 4 (FIG. 1A) or on the thread guide ring 6′ (FIG. 6), respectively, in the direction of the arrows C over the cylindrical thread guide surface 23 or 23′, respectively, onto the conical thread guide surface 11. Owing to the wrapping U (FIG. 3) of the tensioned thread 22 while dispositioned on the conical thread guide surface 11 the tensioned thread 22 is shifted into a notch 24 formed by the conical thread guide surface 11 and its extension 13. From the location of the notch 24 the thread 22 moves into the zone of the underside 18 of the cutting element 12. Due to the rotation of the chuck in the direction of the arrow D (FIG. 3), the thread 22 is caught by the thread guide edge 27 provided on each cutting element 12 and owing to the thread tension it is guided over such thread guide edge 27 and brought to the thread cutting edge 26 which beings above the clamping action-limit line K (FIGS. 1A and 1B) and the thread is then severed by such cutting edge 26. The thread guide edge 27 is slightly rounded in order to protectively guide the thread 22 without damaging the same. The clamping action-limit line K, as viewed from the end surface or face 25, is located behind the clamping surface 19 (FIG. 2A and FIG. 4) or behind the clamping zone KB (FIG. 1A) of the rubber or elastomeric ring 15. Before the thread 22 is severed, it is however already clamped, as it is shifted on the thread guide edge 27, between the underside 18 of the related cutting element 12 and the rubber ring 15 (FIGS. 1A and FIG. 3) or between the clamping surface 19 of the related clamping element 16 and the underside 18 of the corresponding cutting element 12 (FIG. 4). Thus, after severing of the thread 22 there is produced a thread end 28 which is clamped by the clamping point or location and which thread end 28 then is wound upon the next package tube. Thereafter, the thread 22 is placed and wound upon the empty package tube in the manner described in the aforementioned U.S. Pat. Nos. 3,856,222 and 3,921,922.

Figure 3:
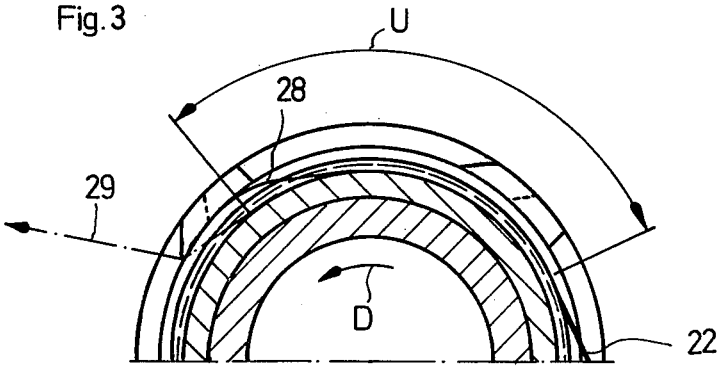
FIG. 3 is a cross-sectional view taken along the line III of the chuck device of FIG. 1, there here being shown the thread and a clamping means in its operating position.
Figure 4:
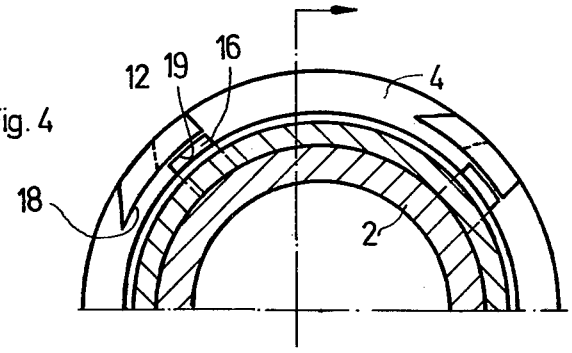
FIG. 4 is a cross-sectional view of the chuck device of FIG. 2, taken substantially along the line IV thereof.
Figure 5:
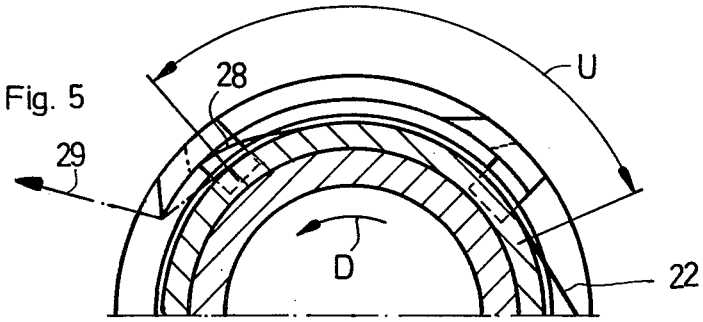
FIG. 5 is a cross-sectional view of the arrangement of FIG. 4, however showing the thread and clamping means in the operating position.

FIGS. 3 and 5 depict, on the one hand, the thread portion 29, shown in dash-dot lines of the thread 22 which is to be severed in the described manner by the thread cutting edge 26 and belonging to the full package (not shown), and, on the other hand, the clamped thread end 28 which is also schematically illustrated in FIG. 1A.

During the subsequent build-up of the next package the thread end 28 now remains clamped, and only after the completed package is stopped, does the rubber ring 15 again come to lie in the groove 14 or the clamping element 16 is placed back into the slot groove 17, respectively, in a manner such that the clamping action previously exerted upon the thread 22 between the rubber ring 15 or the clamping surface 19, respectively, as the case may be, and the underside 18 of the related cutting element 12 is again annihilated and the thread 22 again released, since now no centrifigal force exerts any influence upon the clamping means i.e. the ring 15 or clamping elements 16.

With reference to FIG. 3 it is here furthermore mentioned that the shape of the rubber ring 15 in its operating position has been shown in an idealized manner in the sense that the rubber ring, depending upon the rotational speed of the tube chuck, is more or less deflected between the cutting elements 12, which however does not exert any influence upon the above-described function of the clamping and severing action.

Finally, it is mentioned that purely for manufacturing reasons is it preferable to construct the thread severing ring and the thread guide ring as individual elements or ring members. Yet, the thread severing ring and the thread guide ring could be formed as a one-piece structure while still carrying out their functions. Thus, it is here indicated the thread severing ring 4 or 4' or 4'' and its associated thread guide ring 6 or 6' or 6'', as the case may be, respectively, can be conceptually considered to be integrated into a one-piece structure.

By means of the described apparatus it is possible to reliably clamp the thread during operation and equally to reliably release the thread during standstill of the chuck.

While there are shown and described present preferred embodiments of the invention, it is to be distinctly understood that the invention is not limited, but may be otherwise variously embodied and practiced within the scope of the following claims. ACCORDINGLY,

What we claim is:

1. A chuck device for a tube serving as a package support for textile threads, comprising:

chuck means;

a thread severing ring provided with protruding tooth-shaped cutting elements;

a thread guide ring;

said thread severing ring and thread guide ring being mounted on said chuck means so as to define therebetween a thread catch zone;

said thread guide ring having a thread guide surface extending beneath the cutting elements for guiding the thread in a direction towards the thread severing ring;

said thread guide ring including an extension located adjacent the thread guide surface;

said extension being provided with recess means;

radially movable clamping means arranged in said recess means; and said radially movable clamping means in conjunction with the cutting elements forming clamping locations for the thread caught therebetween at the operating rotational speed of the chuck means.

2. The chuck device as defined in claim 1, wherein:

said recess means comprises a groove provided at said extension;

said clamping means comprising a resilient element seated in said groove.

3. The chuck device as defined in claim 2, wherein:

said resilient element comprises a rubber ring seated in said groove.

4. The chuck device as defined in claim 1, wherein:

said recess means comprises a respective slot groove arranged below each cutting element;

said clamping means comprising a respective clamping element seated in each slot-groove.

5. The chuck device as defined in claim 1, wherein:

each of the tooth-shaped cutting elements has an end surface and a side surface extending at an acute angle with respect to said end surface;

each said side surface having an edge located opposite said clamping means;

each such edge, viewed from the end surface, providing a thread guide edge which merges into a thread cutting edge.

6. The chuck device as defined in claim 1, wherein:

said thread guide ring and said thread severing ring constitute a one-piece structure.

7. The chuck device as defined in claim 1, wherein:

said recess means comprises a groove provided at said extension;

said clamping means comprising an elastomeric member seated in said groove.

8. A chuck device for a tube serving as a package support for textile threads, comprising:

chuck means capable of rotating at a predetermined operating rotational speed;

a thread severing member provided with cutting elements;

a thread guide member;

said thread severing member and said thread guide member being mounted on said chuck means in coacting relationship;

said thread guide member having a thread guide surface for guiding the thread in a direction towards the thread severing member;

said thread guide member being provided with means located adjacent the thread guide surface;

said means located adjacent the thread guide surface being provided with thread clamp-receiving means;

thread clamping means movably arranged in said thread clamp-receiving means; and said movable thread clamping means in conjunction with the cutting elements forming clamping locations for the thread caught therebetween at the operating rotational speed of the chuck means.

* * * * *